US008064812B2

(12) United States Patent
Meade et al.

(10) Patent No.: US 8,064,812 B2
(45) Date of Patent: Nov. 22, 2011

(54) TONER TRANSFER BELT WITH TEXTURED SURFACE FOR ENHANCED TRANSFER AND METHOD OF FORMING TEXTURED SURFACE

(75) Inventors: Alexander D. Meade, Lexington, KY (US); Kathryn D. Mullins, Lexington, KY (US); Peter Brown Pickett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 486 days.

(21) Appl. No.: 12/062,898

(22) Filed: Apr. 4, 2008

(65) Prior Publication Data

US 2009/0252541 A1 Oct. 8, 2009

(51) Int. Cl.
*G03G 15/01* (2006.01)
*G03G 15/08* (2006.01)
*G03G 15/20* (2006.01)

(52) U.S. Cl. ..... 399/302; 399/121; 399/308

(58) Field of Classification Search ..... 399/121, 399/302, 308

See application file for complete search history.

(56) References Cited

U.S. PATENT DOCUMENTS 6,016,417 A * 1/2000 Katsuno et al. ..... 399/308
6,795,667 B2 * 9/2004 Nakazawa et al. ..... 399/111
2005/0249527 A1 * 11/2005 Kuramoto ..... 399/302

* cited by examiner

*Primary Examiner* — David Gray
*Assistant Examiner* — Joseph Wong

(57) ABSTRACT

An intermediate toner transfer belt includes an endless member made of a layer of a material having an endless functional surface adapted to transfer a toner image. The layer of material is textured so as to define a multiplicity of protruding portions of the material spaced apart from each other and integral with and extending outwardly from a remaining base portion of the material. The protruding portions have outer tips spaced apart from one another with outer surfaces thereon also spaced apart from one another such that the endless surface of the endless member is formed by the spaced apart outer surfaces of the outer tips of the protruding portions of the material. Further, the protruding portions are irregular in pattern and shape relative to one another and generally undulate toward and away from the remaining base portion of the material.

10 Claims, 3 Drawing Sheets

TONER TRANSFER BELT WITH TEXTURED SURFACE FOR ENHANCED TRANSFER AND METHOD OF FORMING TEXTURED SURFACE

CROSS REFERENCES TO RELATED APPLICATIONS

None.

STATEMENT REGARDING FEDERALLY SPONSORED RESEARCH OR DEVELOPMENT

None.

REFERENCE TO SEQUENCE LISTING, ETC.

None.

BACKGROUND

1. Field of the Invention

The present invention relates generally to toner transfer belts used in electrophotographic (EP) printers, also called "intermediate transfer belts", and more particularly to such a belt having a textured surface for enhanced toner transfer and to a method of forming the textured surface of the transfer belt.

2. Description of the Related Art

Single pass or multi-pass electrophotographic (EP) printers use single or multi layer intermediate transfer belts with very glossy, hard surfaces and pose toner transfer problems over the life of a customer replaceable unit (CRU) or a field replaceable unit (FRU) that adversely impact both print quality and CRU or FRU longevity.

Toner adheres to a photoconductive (PC) drum after the latent image development. The toner is held onto the PC by forces such as image forces (Coulomb forces), Van der Waals, and dispersion forces. These mechanical and electrical forces are relatively weak and without further plastic deformation or other large forces applied to the toner, the toner can be easily removed electrically or mechanically. Besides the mechanical forces applied to the toner, an electric field is present at the transfer nip which encourages the charged toner to transfer from the PC drum (toner bearing member) to the belt (toner receiving member).

As a result of the smooth and rigid nature of a typical transfer belt, the contact of the belt with isolated toner areas and the PC drum results in the creation of very high and localized pressures. Due to these highly localized pressures, the small toner features subsequently take on a large amount of pressure due to the very small and focused area of contact. Before the toner exits the transfer nip, it is believed that under the high, localized force, the toner particles adhere increasingly to one another as well as to the PC drum ("pressure fusing"). When the belt begins to separate from the PC drum at the exit of the transfer nip, regions of the compressed toner clumps remain adhered to the PC drum and do not transfer, despite the presence of the electric field and the other mechanical forces. These compressed toner clumps frequently produce print artifacts, such as voiding and in particular an example of bad voiding performance is illustrated in FIG. 3B. An example of good voiding performance is illustrated in FIG. 3A.

In order to compensate for these first transfer artifacts, a possible solution is to cover the outer functional surface of the transfer belt with a pure or mostly pure fluoropolymer. However, this can be expensive and its implementation as the solution would only be considered as a last resort. Thus, there is still a need for an innovation that solves the problem of first transfer print artifacts such as voiding of the transfer belt over the life of the belt in a more practical and cost effective manner.

SUMMARY OF THE INVENTION

The present invention provides an innovation that solves the first transfer print artifacts problem, which primarily has taken the form of functional surface voiding, through purposely texturing of the functional surface of the transfer belt. The texturing takes the form of mechanically changing the overall shape of the functional surface of the belt from a glossy smooth one to an irregular undulating one which helps to eliminate the cause, the production of high forces on very small focused areas of contact by compressed toner clumps, and thereby the effects, the print artifacts, on the toner transfer belt, as experienced heretofore. The surface texturing provides a reduction of high forces on toner particles due to only small spaced apart surface areas of contact therewith by a multiplicity of spaced apart outwardly protruding tips of undulations, irregular in pattern and shape, formed on the functional surface of the belt by the texturing thereof. The outwardly protruding tips are closer together than the widths of the toner particles with which they make contact such that the toner particles are supported substantially above the tips and do not become lodged in the spaces between the tips. Also, the additional texture helps impart additional agitation to the toner that is present on the PC thus loosening the associated mechanical adhesion forces.

Accordingly, in an aspect of the present invention, a toner transfer belt is provided which includes an endless member made of at least one layer of a material having an endless functional surface adapted to transfer a toner image wherein the layer of material is textured so as to define a multiplicity of protruding portions of the material spaced apart from each other and integral with and extending outwardly from a remaining base portion of the material.

In another aspect of the present invention, the protruding portions of the material have outer tips also spaced apart from one another with outer surfaces formed thereon being spaced apart from one another such that the endless surface of the endless member is comprised by the spaced apart outer surfaces of the outer tips of the protruding portions of the material. The protruding portions are irregular in pattern and in shape relative to one another and generally undulate toward and away from the remaining base portion of the material.

In a further aspect of the present invention, a method for improving a toner transfer belt for use in an electrophotographic printer is provided including texturing an endless functional surface on an endless layer of a material of a toner transfer belt to produce a multiplicity of protruding portions of the material spaced apart from each other and integral with and extending outwardly from a remaining base portion of the material. The texturing also produces outer tips on the protruding portions of the material having outer surfaces spaced apart from one another such that the textured endless functional surface of the toner transfer belt adapted to contact and receive a toner image from a photoconductive drum and to transfer the toner image to a substrate is comprised by the outer surfaces on the outer tips of the protruding portions of the material.

BRIEF DESCRIPTION OF THE DRAWINGS

Figure 1:
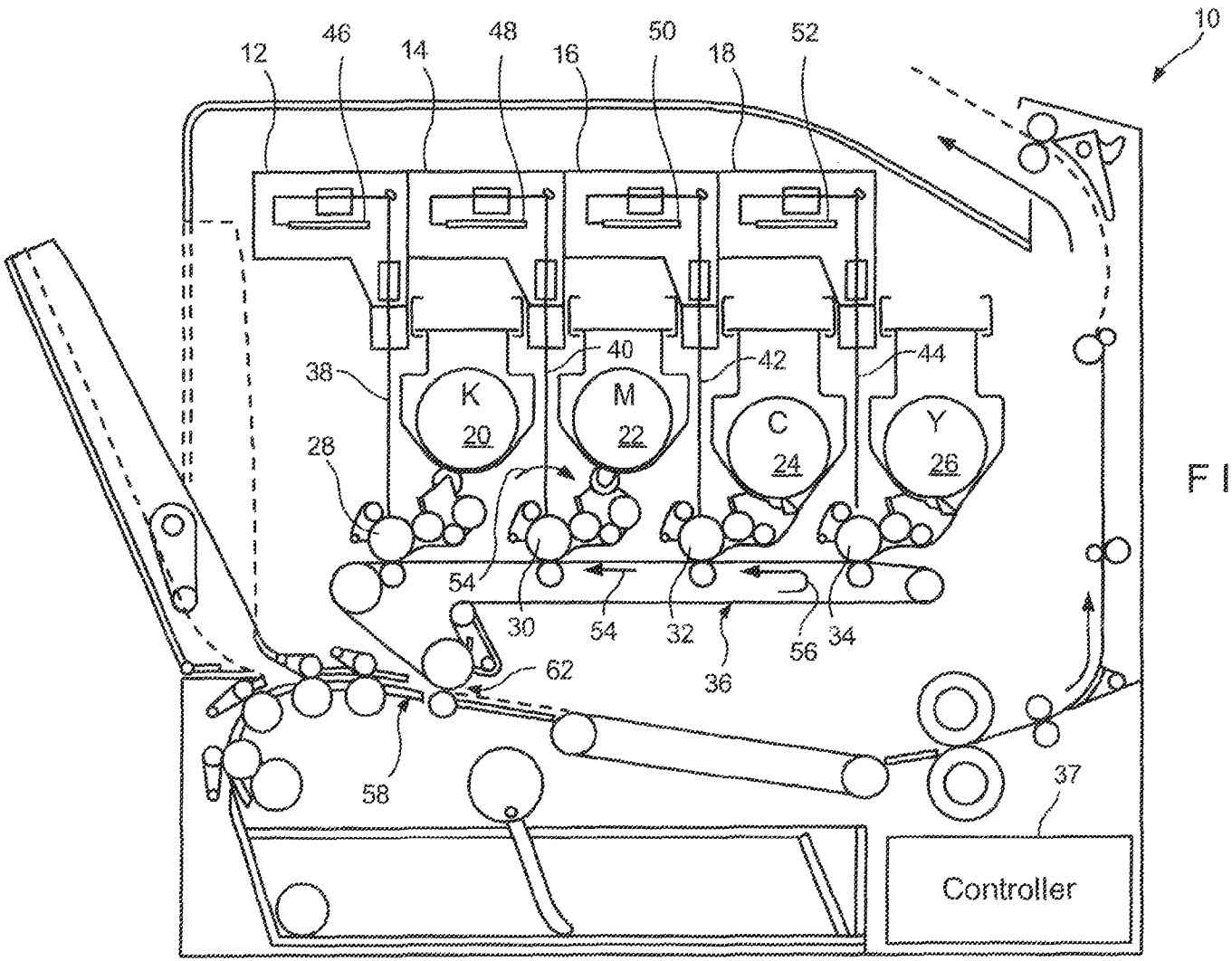

Having thus described the invention in general terms, reference will now be made to the accompanying drawings, which are not necessarily drawn to scale, and wherein:

FIG. 1 is a schematic illustration of a prior art electrophotographic (EP) printer with an intermediate toner transfer belt.

Figure 2:
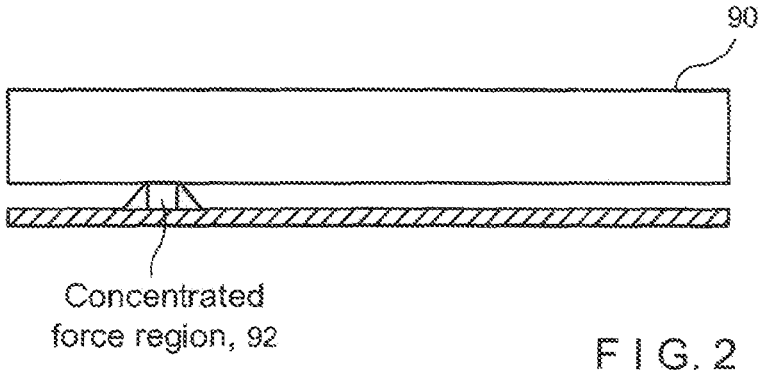
Figure 3A:
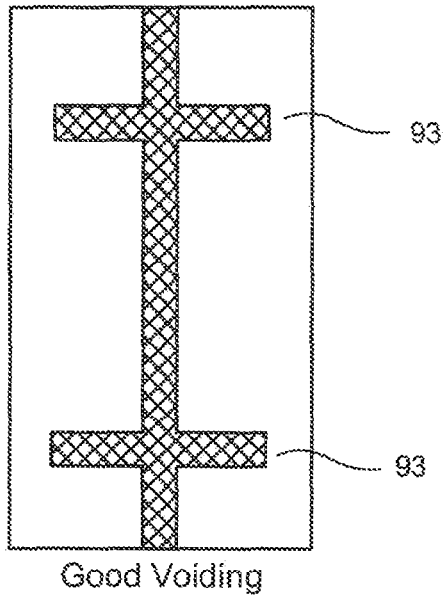
Figure 3B:
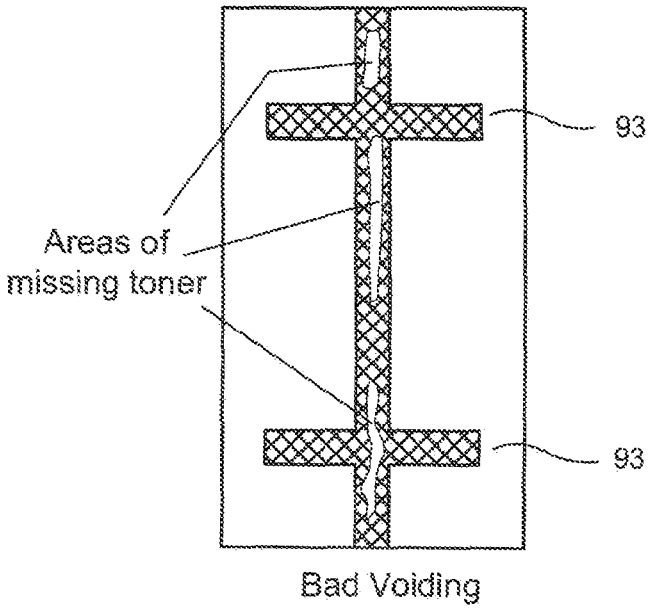
Figure 4:
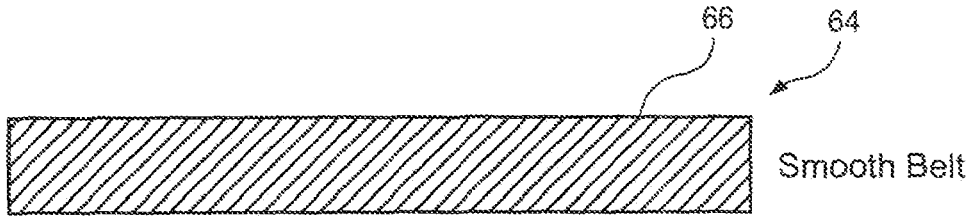
F I G. 4 PRIOR ART
Figure 5:
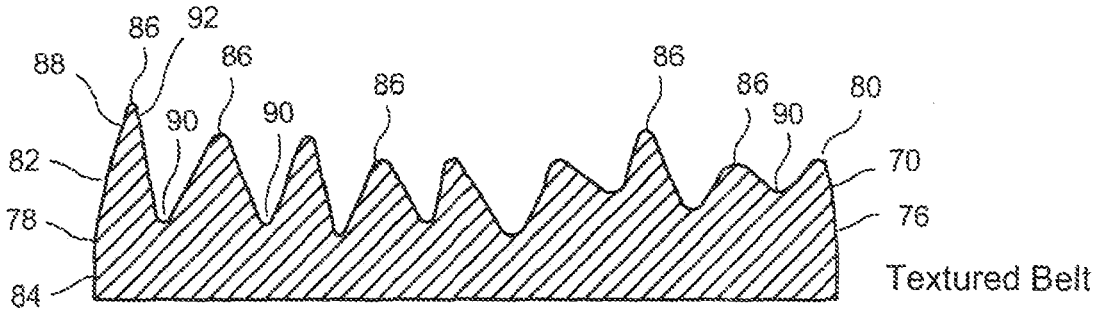

FIG. 2 is an illustration of the concentrated force region for a toner pile against the PC drum;

FIGS. 3A and 3B illustrate voiding in which:

FIG. 3A is an illustration of good voiding achieved in accordance with the teachings of the present disclosure; and FIG. 3B is an illustration of bad voiding with a smooth glossy surface of the conventional transfer belts;

FIG. 4 is a prior art schematic representation of a typical smooth functional surface of a conventional transfer belt; and FIG. 5 is a schematic representation of a textured functional surface of a transfer belt of the present disclosure.

DETAILED DESCRIPTION

The present disclosure now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring to FIG. 1, which is substantially identical to a corresponding figure in U.S. Pat. No. 6,549,225, that is assigned to the same assignee as the present invention, there is shown a multicolor laser printer 10 in which the present invention may be employed. Printer 10 includes laser printheads 12, 14, 16, 18, a black toner cartridge 20, a magenta toner cartridge 22, a cyan toner cartridge 24, a yellow toner cartridge 26, photoconductive drums 28, 30, 32, 34, and intermediate transfer member belt 36 and a controller 37. The controller 37 is a combination of Application Specific Integrated Circuits (ASIC's), microprocessors, and firmware suited to the tasks described.

Each of laser printheads 12, 14, 16 and 18 projects a respective laser beam 38, 40, 42, 44 off a respective one of polygon mirrors 46, 48, 50 and 52. As each of polygon mirrors 46, 48, 50 and 52 rotates, it scans a respective one of reflected laser beams 38, 40, 42 and 44 in a scan direction, perpendicular to the plane of FIG. 1, across a respective one of the PC drums 28, 30, 32 and 34. Each of PC drums 28, 30, 32 and 34 is negatively charged to approximately −1000 volts and is subsequently discharged to a level of approximately −300 volts in the areas of its peripheral surface that are impinged by a respective one of laser beams 38, 40, 42 and 44. During each scan of a laser beam across a PC drum, each of the drums 28, 30, 32 and 34 is continuously rotated, clockwise in the embodiment shown, in a process direction indicated by direction arrow 54. The scanning of laser beams 38, 40, 42 and 44 across the peripheral surfaces of the PC drums is cyclically repeated, thereby discharging the areas of the peripheral surface on which the laser beams impinge.

The toner in each of toner cartridges 20, 22, 24 and 26 is negatively charged and is transported upon the surface of a developer roll biased to approximately −600 volts. Thus, when the toner from cartridge 20, 22, 24 and 26 is brought into contact with a respective one of PC drums 28, 30, 32 and 34, the toner is attracted to and adheres to the portions of the peripheral surfaces of the drums that have been discharged to −300 volts by the laser beams. As belt 36 rotates in the direction indicated by arrow 56, the toner from each of drums 28, 30, 32 and 34 is transferred to the outside surface of the belt 36. As a print medium, such as paper, travels along path 58, the toner is transferred to the surface of the print medium in nip 62.

The material of the belt 36 in FIG. 1 conventionally is ETFE, TPE, polycarbonate, PVDF, or polyimide. Typically transfer belts have glossy hard surfaces that result in transfer problems such as print artifacts including first transfer over the life of the belts, as described heretofore.

FIG. 2 illustrates how force concentration experienced by the toner pile from the PC drum. As can be seen in FIG. 2 there is a narrow vertical line of toner 92 that feels the pressure from the PC drum 90. When this vertical line 92 becomes more distributed due to texturing of the transfer belt of the present disclosure then the voiding effect is removed as the transfer force from the transfer is distributed over a larger area so that the pressure fusing of the toner is eliminated.

FIG. 3A illustrates an example of good voiding with the use of the textured surface for transfer belt of the present disclosure. FIG. 3B illustrates bad voiding due to a smooth glossy surface of a conventional transfer belt. In FIG. 3A there are missing areas of toner within the line pieces 93 compared to that in FIG. 3A.

Referring now to FIG. 4, there is illustrated an intermediate transfer belt 64 having throughout a smooth, glossy functional surface 66, the same as in the prior art. The transfer belt 64 on its smooth glossy functional surface 66 at a surface area 68 makes contact with the toner from a PC drum (not shown in FIG. 4).

Turning now to FIG. 5, there is illustrated another toner transfer belt 70 to which the present disclosure is applied to provide a solution to the print artifacts voiding problem. The solution of the present disclosure involves texturing the entire endless surface area of the transfer belt 64 resulting in improved first transfer due the textured surface scrubbing off toner of of the toner bearing member before transferring to the toner receiving member.

More particularly, the transfer belt 70 is an endless member 76 made of at least one layer of a material 78 having an endless functional surface 80 provided thereon adapted to contact and receive a toner image from the PC drum(s) 28, 30, 32, 34 and to transfer the toner image to the substrate. The layer of the material 78 is textured so as to define a multiplicity of protruding portions 82 of the material 78 spaced apart from each other and integral with and extending outwardly from a remaining base portion 84 of the material 78. The protruding portions 82 of the material 78 have outer tips 86 spaced apart from one another with outer surfaces 88 formed thereon also being spaced apart from one another such that the endless functional surface 80 of the endless member 76 is comprised by the outer surfaces 88 on the outer tips 86 of the protruding portions 82 of the material 78.

The outer surfaces 88 on the outer tips 86 of the protruding portions 82 of the material 78 are spaced apart at distances which are substantially less than widths of the particles P of toner of the toner image supported on the endless surface 76. The outer surfaces 88 are on the outer tips 86 of the protruding portions 82 of the material 78 to make contact with the toner of the toner image and are smaller in area than surface portions of the toner of the toner image that would make contact with a smooth endless surface 66 on the transfer belt 64 seen in FIG. 4. The protruding portions 82 of the material 78 are irregular in pattern and in shape relative to one another and generally undulate between valleys or crevasses 90 of varying depths into the material 78 and peaks 92 of differing heights and shapes in the material 78. The spaced apart outer tips 86 of the protruding portions 82 of the material 78 are separated by distances substantially less than widths of the toner particles P with which the outer tips 86 make contact such that the toner particles P are supported substantially above the peaks 92 in the material 78 defined by the outer tips 86 and above the valleys 90 in the material 78 defined by spaces between the protruding portions 82.

A comparison using the same material of the smooth glossy form of the transfer belt with the textured form of the present invention reveals that the textured form is superior to the smooth form in the existing architecture. The belt surface is designed to move 1.8% faster than the PC drum surface. The speed differential imparts mechanical agitation to the toner on the PC drum while in the transfer nip. As a result of this agitation, the toner transfer in the present electric field in the transfer nip is improved. Although the transfer ability is improved by adding a speed differential, the presence of high localized forces tends to aggravate the transfer quality resulting in first transfer voiding defects. By adding texture to the material on the surface of the transfer belt along with the surface speed differential, much more mechanical agitation occurs. The additional features that now exist on the textured surface, as described above, give more grip to the belt and thus the belt is able to scrub the toner off the PC drum more efficiently without any undesirable side effects to print quality.

The specific texture depth and character have not been found to be critical. Very rough textures are not desirable due to the fact that small toner particles (~10 μm) would become lodged in deep crevices in the textured belt and fail to be removed from the belt later in subsequent operations such as cleaning. Current smooth belts which show print quality defects have roughness in the Ra<0.20 μm (0.48 mm length scan) range where Ra is the average roughness. Examples of belts that have improved transfer quality have had Ra values of >4 μm.

Texturing of the transfer belt can be achieved in the following ways.

The surface of a transfer belt can be textured using a secondary operation. Such an operation can include a mechanical and/or thermal embossing and/or chemical etching.

The surface of the transfer belt can be textured when the extrusion die(s) and/or the sizing dies used for formation of the belt are given a texture pattern profile in the extrusion direction to obtain the textured pattern in the surface of the belt during the extrusion through these die(s).

Texturing can also be achieved by using thermoplastic or cured polymer coatings that are dip coated, spray coated, and spin cast into a textured mandrel to produce a belt with a textured surface.

Texturing of the belt can be effected by using thermoplastic, thermosetting or cure polymers as a coating that is applied as an additional manufacturing operation as a top or intermediate layer via a depositing method such as a spray application.

An external application of air, water or other material causing the outer surface to wrinkle or texture as the belt is extruded out of a melt processing machine such as an extruder prior to melt solidifying.

Another way to texture is by adding an additive that inherently causes the material of the transfer belt to wrinkle during its cooling, setting or curing phase.

The foregoing description of several embodiments of the invention has been presented for purposes of illustration. It is not intended to be exhaustive or to limit the invention to the precise forms described, and obviously many modifications and variations are possible in light of the above teaching. It is intended that the scope of the invention be defined by the claims appended hereto.

What is claimed is

1. In an electrophotographic printer including at least one photoconductive drum at a first transfer station and at least one substrate at a second transfer station, a toner transfer belt comprising:

an endless member made of at least one layer of a material having an endless functional surface provided thereon adapted to contact and receive a toner image from said drum and to transfer said toner image to said substrate;

said layer of said material being textured so as to define a multiplicity of protruding portions of said material spaced apart from each other and integral with and extending outwardly from a remaining base portion of said material;

said protruding portion of said material having outer tips spaced apart from one another with outer surfaces formed thereon being spaced apart from one another such that said endless surface of said endless member is comprised by said outer surfaces on said outer tip of said protruding portions of said material;

wherein said protruding portions of said material are irregular in pattern and in shape relative to one another and generally undulate between valleys and peaks in said material toward and away from said base portion of said material, the valleys having differing depths relative to each other and the peaks having differing heights relative to each other.

2. The printer according to claim 1 wherein said outer surfaces on said outer tips of said protruding portions of said material are spaced apart at distances which are substantially less than widths of particles of toner of said toner image supported on said endless surface.

3. The printer according to claim 1 wherein said outer surfaces on said outer tips of said protruding portions of said material make contact with surface portions on particles of toner of said toner image that are smaller in area than surface portions on the particles of toner of the toner image that would make contact with a smooth endless surface on said endless member.

4. The printer according to claim 1 wherein said spaced apart outer tips of said protruding portions of said material are separated by distances substantially less than widths of said toner particles with which said outer tips make contact such that said toner particles are supported substantially above said peaks in said material defined by said outer tips and above said valleys in said material defined by spaces between said protruding portions.

5. The printer according to claim 1 wherein said protruding portions defined by said textured material of said endless member has an average roughness of approximately 10 μm.

6. The printer according to claim 1 wherein said protruding portions defined by said textured material of said endless member has an average roughness of approximately 4 μm.

7. A method for improving a toner transfer belt for use in an electrophotographic printer, comprising:

texturing an endless functional surface on an endless layer of a material of a toner transfer belt to produce a multiplicity of protruding portions of said material spaced apart from each other and integral with and extending outwardly from a remaining base portion of said material;

said texturing also producing outer tips on said protruding portions of said material having outer surfaces spaced apart from one another such that said textured endless functional surface of said toner transfer belt adapted to contact and receive a toner image from a photoconductive drum and to transfer the toner image to a substrate is comprised by said outer surfaces on said outer tips of said protruding portions of said material, wherein said texturing produced protruding portions of said material are irregular in pattern and in shape relative to one another and generally undulate between valleys and peaks in said material toward and away from said base portion of said material, the valleys having differing depths relative to each other and the peaks having differing heights relative to each other, said texturing comprises at least one of:

chemical etching;

adding an additive that inherently causes said material to wrinkle during at least one of a cooling, setting and curing phase;

extruding said belt as a melt, and externally applying air, water or another material during the extruding and prior to the melt solidifying; and extruding the material through at least one die having a textured pattern profile in a direction of extrusion.

8. The method according to claim 7 wherein said textured endless functional surface of said toner transfer belt has an average roughness within the range of approximately 4 μm to 10 μm.

9. The method according to claim 7 wherein said textured endless functional surface of said toner transfer belt has an average roughness of approximately 10 μm.

10. The method according to claim 7 wherein said texturing includes using extrusion dies or sizing dies in conjunction with forming said toner transfer belt having a given texture pattern profile in the direction of extrusion to obtain said textured endless functional surface of said transfer belt during the extrusion thereof through said sizing dies.

* * * * *